US008611808B2

(12) United States Patent
Tahara

(10) Patent No.: US 8,611,808 B2
(45) Date of Patent: Dec. 17, 2013

(54) CONVEYOR AND IMAGE FORMING APPARATUS INCLUDING CONVEYOR

(75) Inventor: Mitsuhiro Tahara, Osaka (JP)

(73) Assignee: Kyocera Mita Corporation (JP)

( * ) Notice: Subject to any disclaimer, the term of this patent is extended or adjusted under 35 U.S.C. 154(b) by 245 days.

(21) Appl. No.: 13/113,121

(22) Filed: May 23, 2011

(65) Prior Publication Data

US 2011/0293344 A1 Dec. 1, 2011

(30) Foreign Application Priority Data

May 25, 2010 (JP) ..... 2010-119668

(51) Int. Cl.
*G03G 15/00* (2006.01)
*B65H 85/00* (2006.01)
*B65H 29/58* (2006.01)

(52) U.S. Cl.
USPC ..... 399/401; 271/291

(58) Field of Classification Search
USPC ..... 399/401; 271/291
See application file for complete search history.

(56) References Cited

U.S. PATENT DOCUMENTS

| | | | | | |
|---|---|---|---|---|---|
| 5,937,262 | A * | 8/1999 | Cho | ..... | 399/401 |
| 5,974,283 | A * | 10/1999 | Cho | ..... | 399/75 |
| 6,690,909 | B2 * | 2/2004 | Su | ..... | 399/364 |
| 2010/0247200 | A1 * | 9/2010 | Ichiki | ..... | 399/400 |

FOREIGN PATENT DOCUMENTS

| | | | | | |
|---|---|---|---|---|---|
| JP | 05269678 | A * | 10/1993 | ..... | B25B 23/157 |
| JP | 8-192947 | | 7/1996 | | |
| JP | 8169608 | | 7/1996 | | |
| JP | 10-218455 | | 8/1998 | | |
| JP | 2006056627 | A * | 3/2006 | ..... | G03G 15/00 |

* cited by examiner

*Primary Examiner* — Matthew G Marini
*Assistant Examiner* — Nguyen Ha
(74) *Attorney, Agent, or Firm* — Gerald E. Hespos; Michael J. Porco; Matthew T. Hespos

(57) ABSTRACT

A conveyor including a conveyance element configured to rotate in a first rotary direction for sending in a first direction a sheet conveyed along a first path and in an opposite second rotary direction for sending the sheet to a second path including: a guide member for rotating between first and second positions; a first transmission element for transmitting a drive force to the conveyance element; a lever for rotating the guide member to at least one of the first and second positions; a second transmission element connected with the first transmission element to transmit the drive force to the lever; and a transmission controller for controlling transmission of the drive force from the second transmission element to the lever, wherein the transmission controller transmits the drive force from the second transmission element to the lever while the lever rotates the guide member.

10 Claims, 5 Drawing Sheets

CONVEYOR AND IMAGE FORMING APPARATUS INCLUDING CONVEYOR

BACKGROUND OF THE INVENTION

1. Field of the Invention

The present invention relates to a conveyor for conveying a sheet and an image forming apparatus including the conveyor.

2. Description of the Related Art

An apparatus configured to perform various processes on a sheet are widely used. Such an apparatus may comprise a mechanism configured to switch a conveyance path and/or a conveyance direction of a sheet according to a type of process performed on a sheet.

For example, a certain image forming apparatus comprises a conveyance mechanism configured to switch a conveyance path of a sheet using an electromagnetic solenoid. The electromagnetic solenoid is a relatively expensive component and does not meet demands on cost reduction in production. Furthermore, operating sound of the electromagnetic solenoid is inappropriate for an apparatus used in an area where quiet environment is required.

An improved image forming apparatus comprises a roller and a claw. This image forming apparatus switches a conveyance direction of a sheet while nipping the sheet between the roller and the claw. According to the principle of this image forming apparatus, the above mentioned drawbacks of the electromagnetic solenoid are solved.

The nip between the roller and the claw, however, may damage the sheet (particularly damage to a formed image) although the improved image forming apparatus has advantages of reduction in production cost and silence.

SUMMARY OF THE INVENTION

It is an object of the present invention to provide an inexpensively manufactured and silent conveyor configured to switch a conveyance direction of a sheet with giving a sheet less load and an image forming apparatus including the conveyor.

One aspect of the present invention provides a conveyor including a conveyance element configured to rotate in a first rotary direction for sending in a first direction a sheet conveyed along a first path and in a second rotary direction opposite to the first rotary direction for sending the sheet to a second path including: a guide member configured to rotate between a first position where the first path opens and a second position where the first path closes and the second path opens; a first transmission element configured to transmit a drive force to the conveyance element; a lever configured to rotate the guide member to at least one of the first position and the second position; a second transmission element connected with the first transmission element to transmit the drive force to the lever; and a transmission controller configured to control transmission of the drive force from the second transmission element to the lever, wherein the transmission controller transmits the drive force from the second transmission element to the lever while the lever rotates the guide member.

Another aspect of the present invention provides an image forming apparatus for forming an image on a sheet including: an image forming unit configured to form the image on the sheet; a housing configured to define a first path for guiding the sheet fed from the image forming unit and a second path for guiding the sheet on which the image is formed back to the image forming unit; and a conveyor including a conveyance element configured to rotate in a first rotary direction to send the sheet transferred along the first path in a direction to discharge the sheet outside the housing and in a second rotary direction to pull the sheet back into the housing to send the sheet to the second path, wherein the conveyor includes: a first transmission element configured to transmit drive force to the conveyance element; a lever configured to rotate a guide member to at least one of a first position where the first path opens and a second position where the first path closes and the second path opens; a second transmission element connected with the first transmission element to transmit the drive force to the lever; and a transmission controller configured to control transmission of the drive force from the second transmission element to the lever, and the transmission controller transmits the drive force from the second transmission element to the lever while the lever rotates the guide member.

DETAILED DESCRIPTION OF THE PREFERRED EMBODIMENTS

A conveyor and an image forming apparatus according to one embodiment are now described with reference to the accompanying drawings. Directional terms such as "up", "down", "left" and "right" to be used hereinafter are merely for clarifying the description, and shall not in any way limit principles of the conveyor and the image forming apparatus. A term "sheet" to be used in the following description refers to copy paper, tracing paper, thick paper, an OHP sheet and other sheets on which images may be formed.

Figure 1:
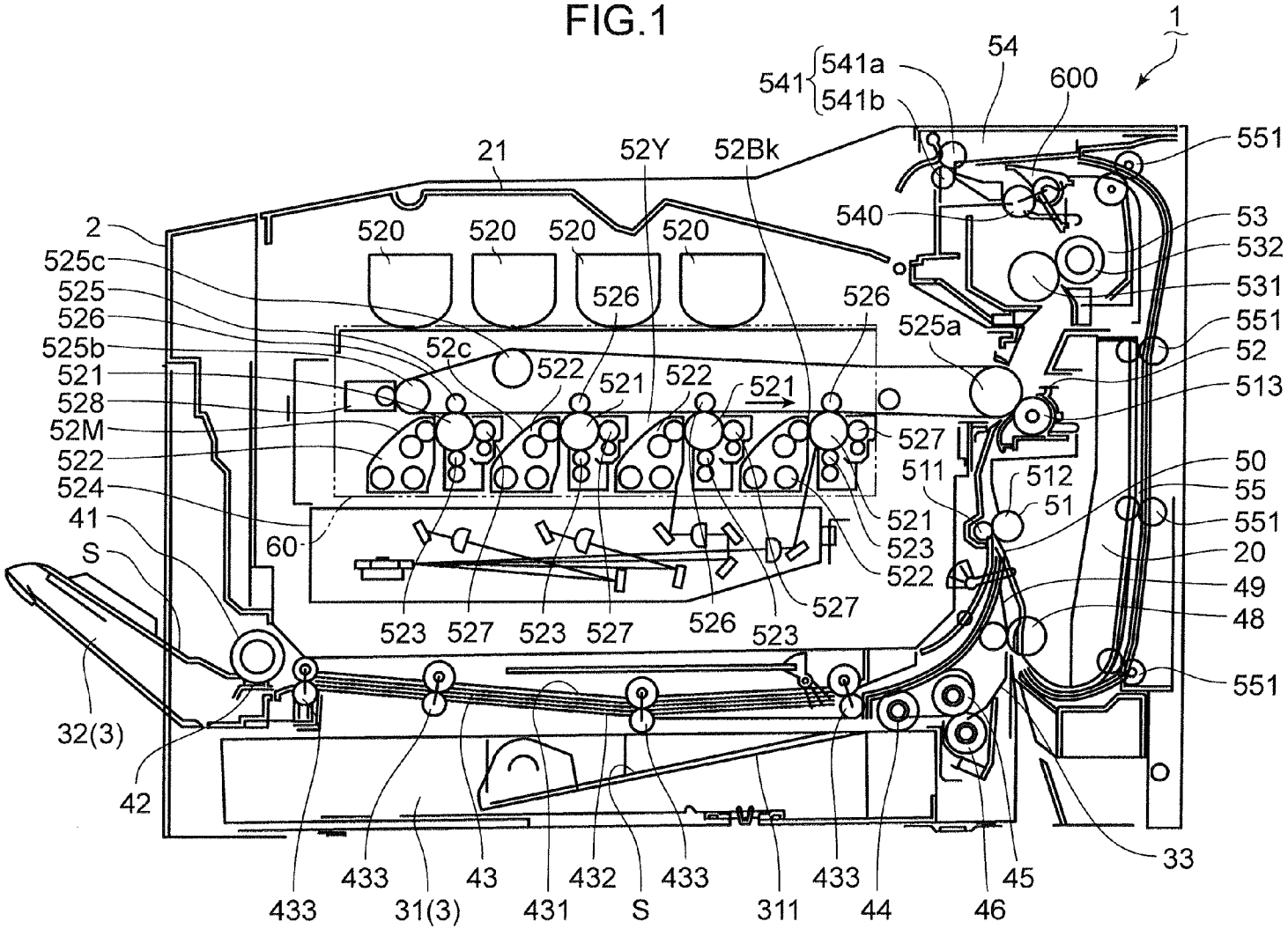
FIG. 1 is a schematic diagram depicting an internal structure of an image forming apparatus according to one embodiment.

FIG. 1 schematically shows an internal structure of an image forming apparatus according to one embodiment. The image forming apparatus shown in FIG. 1 is exemplified as an apparatus incorporating a conveyor constructed on the basis of principles to be described below. The principles to be described below may be applied to various apparatuses configured to perform other processes than image forming process on sheets. In the following description, a color printer is exemplified as the image forming apparatus. A monochrome printer, a copier, a facsimile apparatus or other apparatuses configured to form an image on a sheet may be used as the image forming apparatus.

The image forming apparatus 1 receives, for example, external signals including information on an image and forms the image on the basis of the signals. The image forming apparatus 1 comprises a substantially rectangular boxed housing 2 for accommodating various apparatuses configured to form an image on a sheet S based on the external signals (e.g. various elements constituting a later mentioned cassette 31, image forming unit 52, fixing unit 53 and discharging unit 54).

The image forming apparatus 1 comprises a storage unit 3 configured to store the sheet S. The storage unit 3 includes a cassette 31 to be set in the housing 2 and an insertion tray 32 which protrudes from a left surface of the housing 2. The insertion tray 32 is configured to support the sheet S. A feed roller 41 and a separation pad 42 are disposed at a base end of the insertion tray 32. The sheet S placed on the insertion tray 32 inclined downward toward the base end of the insertion tray 32 contacts the feed roller 41 and/or the separation pad 42. The sheet S is fed from the insertion tray 32 into the housing 2 when the feed roller 41 rotates. When several sheets S are fed into the housing 2 by the feed roller 41, the separation pad 42 causes a frictional force to prevent the sheets S except the top sheet S from being fed into the housing 2. As a result, the sheets S are fed into the housing 2 from the insertion tray 32 one by one.

A first feeding path 43 extends to the right from the feed roller 41 and/or the separation pad 42. The first feeding path 43 in the housing 2 is defined between an upper wall 431 and a lower wall 432. The lower wall 432 below the upper wall 431 confronts the upper wall 431. Several conveyance roller pairs 433 configured to convey the sheet S is disposed in position along the first feeding path 43. The first feeding path 43 is curved and extends upward from the horizontal direction to the vertical direction.

The cassette 31 is disposed below the horizontally extending first feeding path 43. The detachable cassette 31 is inserted into the housing 2. The substantially rectangular boxed cassette 31 upwardly opens so that a user put the sheet S therein. A lift plate 311 configured to support the sheet S is disposed in the cassette 31. The lift plate 311 is upwardly inclined toward the right.

A pickup roller 44 is disposed above a right edge of the lift plate 311. The sheet S is nipped by the right edge of the lift plate 311 and the pickup roller 44. The sheet S is fed from the cassette 31 when the pickup roller 44 rotates. A feed roller 45 and a separation roller 46 are disposed after the pickup roller 44. The feed roller 45 rotates in the same direction as the pickup roller 44 so as to feed the sheet S downstream. The separation roller 46 underneath the feed roller 45 rotates so as to feed the sheet S, which has been sent by the pickup roller 44, back to the cassette 31. If the pickup roller 44 feeds several sheets S from the cassette 31, the separation roller 46 brings the sheets S except the top sheet back to the cassette 31. Thus the sheets S are fed downstream by the feed roller 45 one by one.

A guide wall 33, which curves upward to the right, is placed after the feed roller 45. A conveyance roller pair 48 is disposed above the guide wall 33. The conveyance roller pair 48 conveys the sheet upward. A second feeding path 49 configured to guide the sheet S fed from the cassette 31 joins together the above mentioned first feeding path 43 after the conveyance roller pair 48 to form a confluent conveyance path 50. In this embodiment, the confluent conveyance path 50 is exemplified as the first path along which the sheet is conveyed.

A resist roller pair 51, the image forming unit 52, the fixing unit 53 and the discharging unit 54 are disposed, respectively, in the middle of the upwardly extending confluent conveyance path 50. The resist roller pair 51 is disposed near a lower end of the confluent conveyance path 50. The resist roller pair feeds the sheet S to the image forming unit 52 in synchronization with the image forming process of the image forming unit 52. The resist roller pair 51 includes a first resist roller 511 installed on an inner wall of the housing 2 and a second resist roller 512 installed in a conveyance unit 20. The first and second resist rollers 511, 512 nip and convey the sheet S upward.

The image forming unit 52 forms a toner image on the sheet S conveyed along the confluent conveyance path 50. A magenta unit 52M configured to form a toner image using magenta toner, a cyan unit 52C configured to form a toner image using cyan toner, a yellow unit 52Y configured to form a toner image using yellow toner, and a black unit 52Bk configured to form a toner image using black toner, are disposed in the housing 2. The magenta unit 52M, the cyan unit 52C, the yellow unit 52Y and the black unit 52Bk are sequentially disposed from left to right.

Each of the units 52M, 52C, 52Y and 52Bk has a developing apparatus 522 configured to supply toner to a photosensitive drum 521. After an electrostatic latent image is formed on a circumferential surface of the photosensitive drum 521, the toner is supplied from the developing apparatus 522 to form a toner image (visible image) corresponding to the electrostatic latent image.

The photosensitive drum 521 in FIG. 1 rotates clockwise. The toner image formed on the photosensitive drum 521 is transferred to an intermediate transfer belt 525 which moves above the photosensitive drum 521.

Four removable toner cartridges 520 configured to contain the magenta toner, the cyan toner, the yellow toner and the black toner, respectively, are attached in the housing 2. These toner cartridges 520 are disposed between the intermediate transfer belt 525 and an upper wall 21 of the housing 2 configured to support the sheet S discharged from the discharging unit 54. The toner is replenished to the units 52M, 52C, 52Y and 52Bk, respectively, through toner replenishment ducts (not shown), which extend from the toner cartridges 520 to the units 52M, 52C, 52Y and 52Bk, respectively.

The image forming unit 52 further includes charging devices 523 disposed below the photosensitive drums 521 of the units 52M, 52C, 52Y and 52Bk respectively, and an exposure device 524 disposed below the charging devices 523. The charging devices 523 uniformly charge the circumferential surface of the photosensitive drums 521. The exposure device 524 irradiates a laser beam onto the circumferential surface of the charged photosensitive drum 521 based on the digital signals about the received image data. As a result, an electrostatic latent image corresponding to a color component of an original document is formed on the circumferential surface of each photosensitive drum 521 of the units 52M, 52C, 52Y or 52Bk. Then the developing apparatus 522 supplies the toner to the circumferential surface of the photosensitive drum 521. As a result, the toner electrostatically adheres to the electrostatic latent image to form the toner image.

The intermediate transfer belt 525 above each of the photosensitive drums 521 extends between a right drive roller 525*a* and a left idler 525*b*. The lower surface of the lower half of the intermediate transfer belt 525 (moves to the right) abuts the circumferential surfaces of the photosensitive drums 521, respectively. The outer surface of the intermediate transfer belt 525 is configured to bear the toner. Transfer rollers 526 are disposed above the photosensitive drums 521, respectively. The intermediate transfer belt 525 pressed against the circumferential surfaces of the photosensitive drums 521 by the transfer rollers 526 runs between the drive roller 525*a* and the idler 525*b*. A tension roller 525*c* is disposed between the drive roller 525*a* and the idler 525*b*. The tension roller 525*c* is biased upward by a biasing member (not shown). The tension roller 525*c* pushed upward by the biasing member creates a convex profile of the tensed intermediate transfer belt 525, which protrudes upward near the idler 525*b*.

While the intermediate transfer belt 525 rotates, the photosensitive drum 521 of the magenta unit 52M transfers a toner image of the magenta toner to the intermediate transfer belt 525. Then the cyan unit 52C transfers a toner image of the cyan toner onto the magenta colored toner image. After that, the yellow unit 52Y transfers a toner image of the yellow toner onto the superposed toner images of the magenta toner and the cyan toner. Finally the black unit 52Bk transfers a toner image of the black toner onto the superposed toner images of the magenta toner, the cyan toner and the yellow toner to complete a full color toner image. The complete full color toner image on the intermediate transfer belt 525 is transferred to the sheet S conveyed from the storage unit 3.

The sheet S guided and conveyed along the confluent conveyance path 50 vertically extending at the right side of the image forming unit 52 is directed to a secondary transfer nip portion defined by a second transfer roller 513 and the intermediate transfer belt 525. The second transfer roller 513 is disposed on the confluent conveyance path 50. The second transfer roller 513 confronting the drive roller 525*a*, around which the intermediate transfer belt 525 is wound, contacts the outer surface of the intermediate transfer belt 525 to form the secondary transfer nip portion. The sheet S guided along the confluent conveyance path 50 and fed to the secondary transfer nip portion between the intermediate transfer belt 525 and the second transfer roller 513, is nipped between the intermediate transfer belt 525 and the second transfer roller 513. As a result, the complete full color toner image on the intermediate transfer belt 525 is transferred to the sheet S.

The image forming apparatus 1 further includes a cleaning apparatus 528. The cleaning apparatus 528 removes toner remaining on the intermediate transfer belt 525 after the toner image is transferred to the sheet S (normally called the secondary transfer) to clean the intermediate transfer belt 525. The cleaning apparatus 528 confronts the idler 525*b*.

The fixing unit 53 configured to perform a fixing process on the toner image transferred onto the sheet S by the image forming unit 52, includes a heating roller 531 and a pressure roller 532 confronting the heating roller 531. The heating roller 531 encloses an electric heater as a heating source.

The sheet S bearing the toner image is conveyed to the fixing unit 53. While the sheet S passes between the pressure roller 532 and the heating roller 531 at a high temperature, the toner image receiving heat from the heating roller 531 is fixed to the sheet S.

The fixing process by the fixing unit 53 completes and the color printing ends. The color printed sheet S is guided along the confluent conveyance path 50 extending upward from the fixing unit 53 and discharged from the discharging unit 54. The upper surface (upper wall 21) of the housing 2 is used as a discharge tray configured to support the color printed sheet S.

A relay apparatus 60 is disposed in the housing 2 along a front wall of the housing 2. The upper surface of the relay apparatus 60 is configured to support a front edge of each toner cartridge 520. The various components of the image forming apparatus 1 such as the photosensitive drums 521, the intermediate transfer belt 525, the development apparatuses 522 and the charging apparatuses 523 are disposed behind the relay apparatus 60. The relay apparatus 60 relays the toner supplied from the toner cartridges 520 to each of the development apparatuses 522 below the intermediate transfer belt 525.

The relay apparatus 60 stores the waste toner generated after the transfer process. Cleaning apparatuses 527 are disposed on the right side of the photosensitive drums 521, respectively. The cleaning apparatus 527 removes toner remaining on the circumferential surface of the photosensitive drum 521 after finishing the transfer of the toner image to the intermediate transfer belt 525 (called primary transfer). The removed toner is stored in the relay apparatus 60 as the waste toner. The circumferential surface of each photosensitive drum 521 cleaned by the cleaning apparatus 527 moves toward the charging apparatus 523 to be subject to the charging process again. The cleaning apparatus 528 confronts the idler 525*b* at the left side of the intermediate transfer belt 525. The cleaning apparatus 528 removes toner remaining on the outer surface of the intermediate transfer belt 525 after finishing the transfer of the toner image to the sheet S (called secondary transfer). The removed toner is stored in the relay apparatus 60 as the waste toner. The outer surface of the intermediate transfer belt 525 cleaned by the cleaning apparatus 528 then is subjected to transfer of a new toner image from each photosensitive drum 521.

As shown in FIG. 1, the image forming apparatus 1 may print images on both sides of the sheet S. The sheet S after the image fixing process on one side by the fixing unit 53 is sent to a discharge roller pair 541 by a conveyance roller pair 540 disposed in the discharging unit 54. In the present embodiment, the discharging unit 54 is exemplified as the conveyor configured to convey the sheet S.

If printing on only one side is instructed by external signals, the sheet S is directly discharged onto the upper wall 21 of the housing 2. If double sided printing is instructed by the external signal, the discharge roller pair 541 discharges the sheet S outside the housing 2 only by a predetermined amount, then rotates in reverse so as to draw the sheet S back into the housing 2. Then the sheet S is fed into a return path 55 extending downward along the right surface of the housing 2. In the present embodiment, the return path 55 is exemplified as the second path along which the sheet S is conveyed.

The discharge roller pair 541 includes an upper roller 541*a* and a lower roller 541*b*. In the present embodiment, the upper roller 541*a*, to which a later mentioned drive gear (not shown in FIG. 1) is connected, is exemplified as the conveyance element configured to convey the sheet S. In the present embodiment, the conveyance direction of the sheet S toward the outside of the housing 2 is exemplified as the first direction. The conveyance direction of the sheet S to draw the sheet S back into the housing 2 is exemplified as the second direction. The rotary direction of the upper roller 541*a* during the conveyance of the sheet S in the first direction (clockwise in FIG. 1) is exemplified as the first rotary direction. The rotary direction of the upper roller 541*a* during the conveyance of the sheet in the second direction (counterclockwise in FIG. 1) is exemplified as the second rotary direction.

A conveyance roller pair 551 configured to convey the sheet S is disposed in position along the return path 55. The return path 55 curving to surround the right and lower surface of the conveyance unit 20 merges to the second feeding path 49 before the nip portion defined by the conveyance roller pair 48. Therefore the sheet S fed into the return path 55 is conveyed into the resist roller pair 51 again by the conveyance roller pair 48. Then the resist roller pair 51 feeds the sheet S to the image forming unit 52 in synchronization with the image formation by the image forming unit 52. In the present embodiment, the return path 55 is exemplified as the second path configured to guide the sheet S, on which the image forming process has been performed, into the image forming unit 52 again.

The image forming unit 52 forms an image on a blank surface (unprinted surface) of the sheet S. Then a new toner image is fixed on the sheet S by the fixing unit 53, and the sheet S is discharged onto the upper wall 21 of the housing 2 by the discharge roller 541. As shown in FIG. 1, both sides of the sheet are printed because of the formation of the confluent conveyance path 50 configured to guide the sheet fed from the image forming unit 52 to the discharging unit 54 and the return path 50 connected with the confluent conveyance path 50 in the discharging unit 54 to guide the sheet S, on which the image forming process has been performed, to the image forming unit 52 again.

Figure 2:
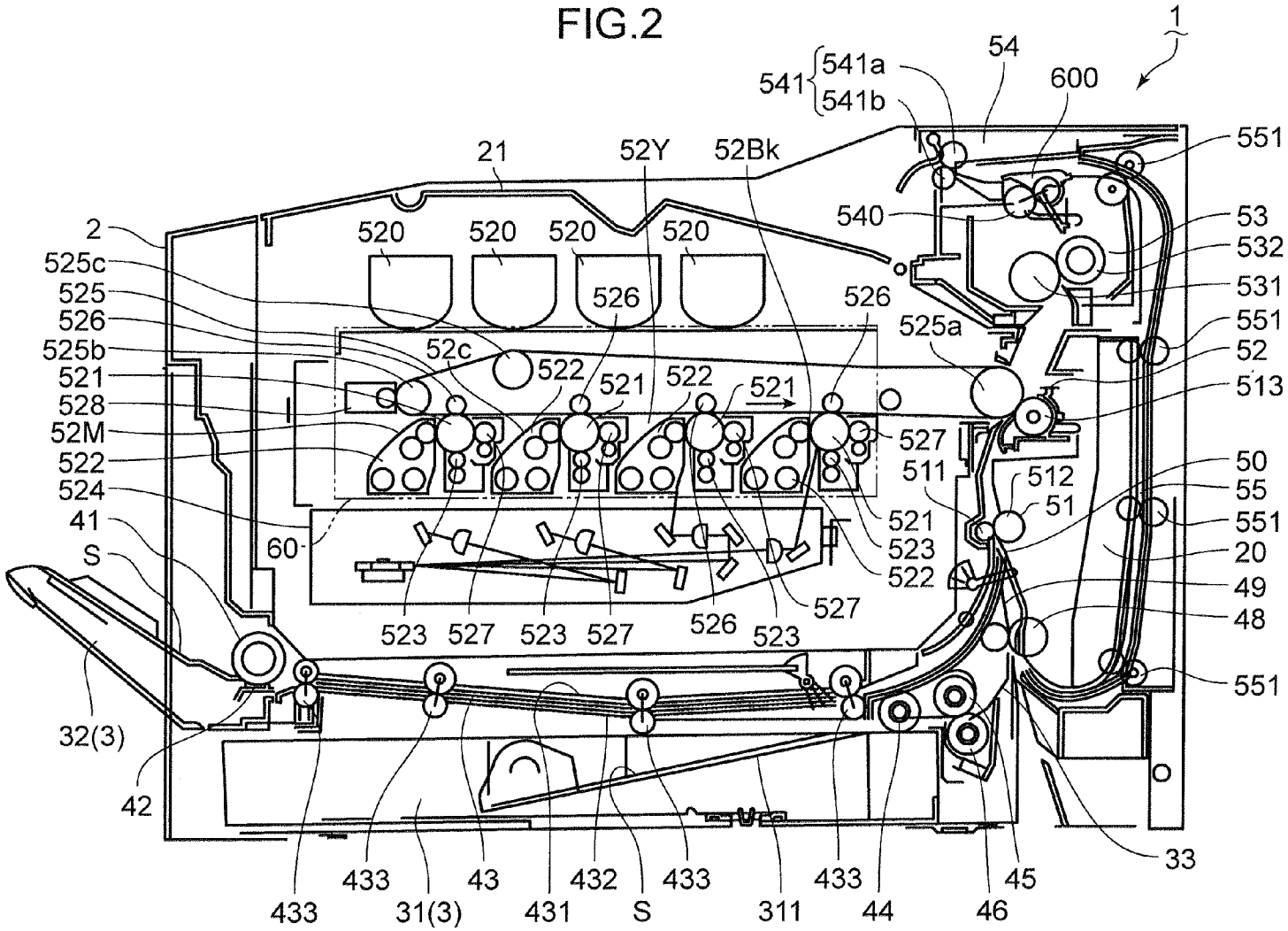
FIG. 2 is a schematic diagram depicting the internal structure of the image forming apparatus according to one embodiment.

FIG. 2 is a schematic view depicting operation of the discharging unit 54 when the sheet S is returned toward the return path 55. The operation of the discharging unit 54 will be generally described with reference to FIGS. 1 and 2.

As shown in FIGS. 1 and 2, the discharging unit 54 includes the guide member 600 near the conveyance roller pair 540. The guiding member 600 shown in FIG. 1 is located in the first position. The guiding member 600 shown in FIG. 2 is located in a second position. The guiding member 600 in the first position opens the confluent conveyance path 50 used as the first path whereas the guide member 600 in the second position closes the confluent conveyance path 50 and opens the return path 55 used as the second path. The guide member 600 is installed to the inner wall of the housing 2 so as to be rotatable between the first position and the second position. The phrases "open the transporting path", "open the path" and the like used hereinafter refer to guiding the sheet S in a predetermined direction without interrupting conveyance of the sheet S. The phrases "close the conveyance path", "close the path" and the like used hereinafter refer to interrupting downstream conveyance of the sheet S.

As shown in FIG. 1, when the tip of the guide member 600 is located in an upper position, a gently curved lower surface of the guide member 600 guides the sheet S from the conveyance roller pair 540 to the discharge roller pair 541. Meanwhile the guide member 600 protrudes so as to cross and close the return path 55 extending from the discharge roller pair 541. When the tip of the guide member 600 is in a lower position, as shown in FIG. 2, on the other hand, the lower surface of the guide member 600 lies down so as to close the confluent conveyance path 50, and the upper surface of the guide member 600 is used as a wall surface constituting the return path 55. While the guide member 600 is in the first position, the upper roller 541*a* of the discharge roller pair 541 rotates in the first rotary direction to discharge the sheet S to the outside of the housing 2. While the guide member 600 is in the second position, the upper roller 541*a* of the discharge roller pair 541 rotates in the second rotary direction to draw the sheet S back into the housing 2.

Figure 3:
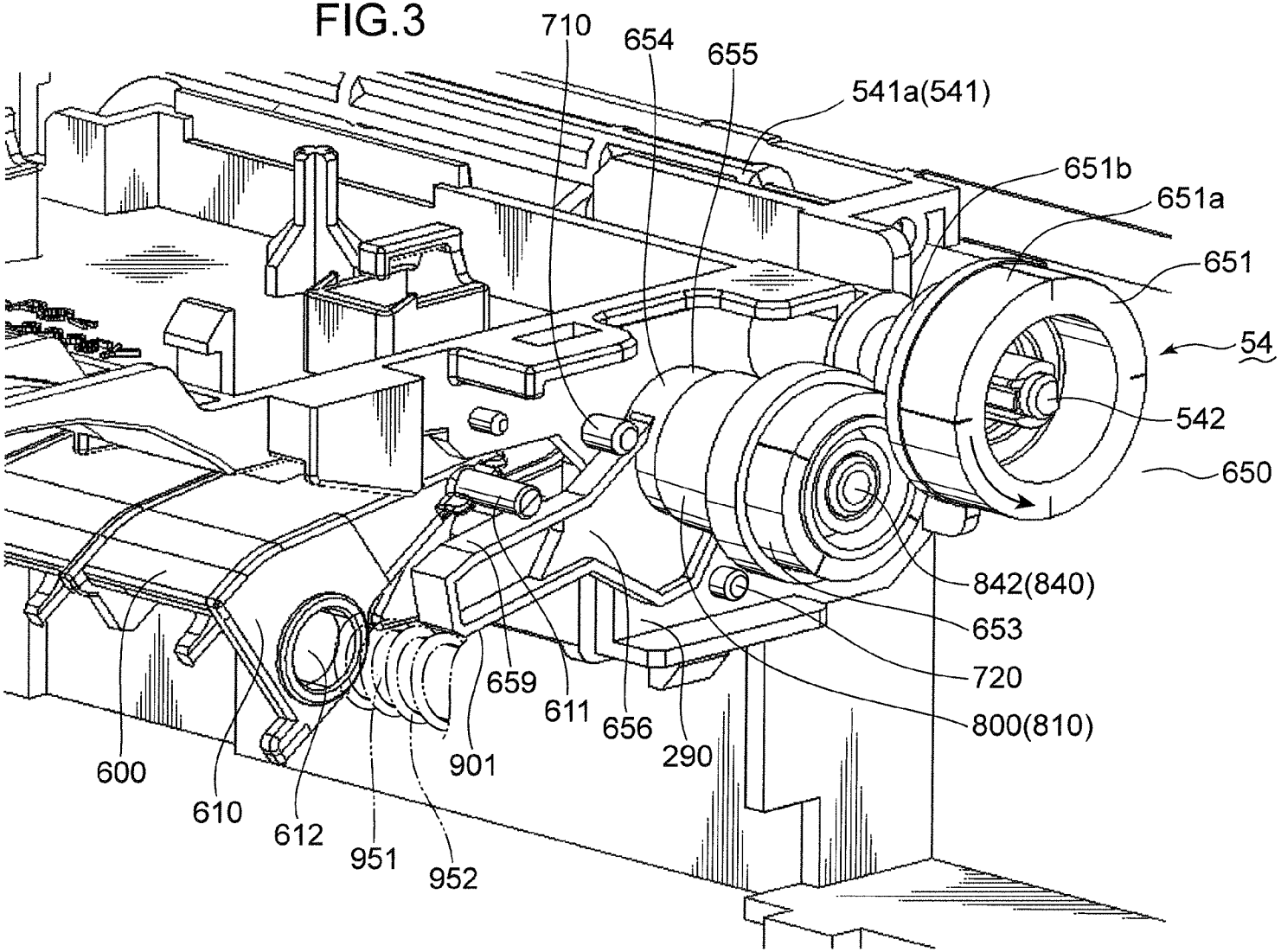
FIG. 3 is a perspective view depicting an interlocking mechanism of the image forming apparatus shown in FIGS. 1 and 2.

FIG. 3 is an enlarged perspective view of the discharging unit 54. In FIG. 3, the housing 2 is partially omitted so that the guide member 600 is clearly shown. Instead, the remaining portion of the housing 2 shown in FIG. 3 is described as "housing wall 290". The discharging unit 54 is described with reference to FIG. 3.

The guide member 600 which substantially looks like a triangular prism, as shown in FIG. 3, is located in the first position. An opening 612 is defined on an end surface 610 formed with a substantially triangular plate of the guide member 600. A shaft 951 protruding from the inner surface of the housing wall 290 (in FIG. 3, a portion of the housing wall 290 connected with the guide member 600 is omitted) is inserted through the opening 612. The guide member 600 is supported by the shaft 951 so as to rotate upward and downward. A torsion bar spring 952 is used, in addition to the shaft 951, to connect the housing wall 290 with the guide member 600 according to the present embodiment. The torsion bar spring 952 biases the guide member 600 toward the second position. Alternatively, the torsion bar spring 952 may bias the guide member 600 toward the first position. Further alternatively, only the shaft 951 may be used for the connection of the guiding member 600 and the housing wall 290. In the present invention, the torsion bar spring 952 is exemplified as a biasing member.

The guide member 600 rotates between the first position and the second position around the shaft 951 inserted into the opening 612. A substantially cylindrical pin 611 protrudes from the end surface 610 of the guide member 600. A tip of the pin 611 appearing outside the housing wall 290 contacts an interlocking mechanism 650 mounted on the outer surface of the housing wall 290. The interlocking mechanism 650 rotates the guide member 600 between the first position and the second position via the pin 611. When the upper roller 541*a* of the discharge roller pair 541 rotates in the first rotary direction (direction to discharge the sheet S outside the housing 2), the interlocking mechanism 650 rotates the guide member 600 toward the first position. While the guide member 600 is rotated to the second position due to the torsion bar spring 952 used for connecting the housing wall 290 with the guide member 600, the interlocking mechanism 650 interlocks with the rotating guide member 600 not to interrupts downward movement of the pin 611.

If the torsion bar spring 952 used for connecting the housing wall 290 with the guide member 600 biases the guide member 600 toward the first position, the interlocking mechanism 650 may rotate the guide member 600 toward the second position. In this case, while the guide member 600 is rotated toward the first position by the torsion bar spring 952, the interlocking mechanism 650 preferably interlocks with the rotating guide member 600 so as not to interrupt the pin 611 from moving up.

The interlocking mechanism 650 may rotate the guide member 600 toward the first position and the second position. In this case, the biasing member configured to bias the guide member 600 toward the first position or the second position is not necessary.

In FIG. 3, the upper roller 541*a* of the discharge roller pair 541 is shown whereas the lower roller 541*b* (see FIG. 1 and FIG. 2) is not shown because the lower roller 541*b* is behind the housing wall 290.

The interlocking mechanism 650 includes a drive gear 651 mounted on an end of the shaft 542 of the upper roller 541*a* of the discharge roller pair 541. In the present embodiment, the drive gear 651 is exemplified as the first transmission element configured to transmit a drive force to the upper roller 541*a* of the discharge roller pair 541.

A drive force from a drive source (not shown) configured to bi-directionally rotate is input to the drive gear 651 outside the housing wall 290. Therefore the drive gear 651 may rotate in a direction to discharge the sheet S out of the housing 2, and in a direction to draw the sheet S back into the housing 2. The drive gear 651 shown in FIG. 3 rotates counterclockwise. The drive gear 651 looks like a substantially multi-stage cylinder. In the drive gear 651, a gear portion 651*b* smaller in diameter is formed between a gear portion 651*a* larger in diameter and the housing wall 290. The drive force from the drive source is input, for example, to the larger gear portion 651*a*. As a result, the drive gear 651 rotates with the shaft 542 according to the rotary direction of the drive source. As a result, the upper roller 541*a*, to which the drive force from the drive source is transmitted, selectively rotates in the first rotary direction or the second rotary direction.

The interlocking mechanism 650 includes a relay gear 653 configured to engages with the smaller gear portion 651*b* of the drive gear 651, a lever 654 configured to contact with the pin 611 of the guiding element 600, and a torque limiter 800 disposed between the relay gear 653 and the lever 654. The relay gear 653 is exemplified as a second transmission element connected with the first transmission element to transfer drive force to the lever 654. The first transmission element and the second transmission element are not limited to those having a gear structure. For example, such structures as pullies interconnected via a belt, or frictional disks configured to rotate by friction of their circumferential surfaces contacting each other, may be used as the first transmission element and the second transmission element. The torque limiter 800 is exemplified as the transmission controller configured to control transfer of the drive force from the relay gear 653 to the lever 654. In the present embodiment, it is likely the torque limiter 800 prevents excessive load from working on the second transmission element (relay gear 653) and/or the lever 654.

The lever 654 includes a rotatable cylinder 655 connected to the outer surface of the housing wall 290, and an arm 656 extending from a circumferential surface of the cylinder 655. In the present embodiment, an upper edge 659 of the arm 656 contacts the pin 611. If the torsion bar spring 952 used for connecting the housing wall 290 with the guide member 600 biases the guide member 600 toward the first position, the arm 656 may be disposed so that a lower edge 901 of the arm 656 contacts the pin 611. If the interlocking mechanism 650 guides the guiding member 600 to the first position and the second position, the arm 656 may be configured to interpose the pin 611 (e.g. a slit into which the pin 611 is inserted may be defined in the arm 656). Thus the guide member 600 is rotated to at least one of the first position and the second position by the lever 654.

The relay gear 653, the torque limiter 800 and the lever 654 rotate around the same rotational axis. The drive force from the drive gear 651 is transmitted to the relay gear 653 via the smaller gear portion 651*b*. While the guide member 600 moves from the second position to the first position, the drive force from the relay gear 653 is transmitted to the lever 654 via the torque limiter 800. As a consequence, the arm 656 of the lever 654 rotates upward around the cylinder 655.

Figure 4A:
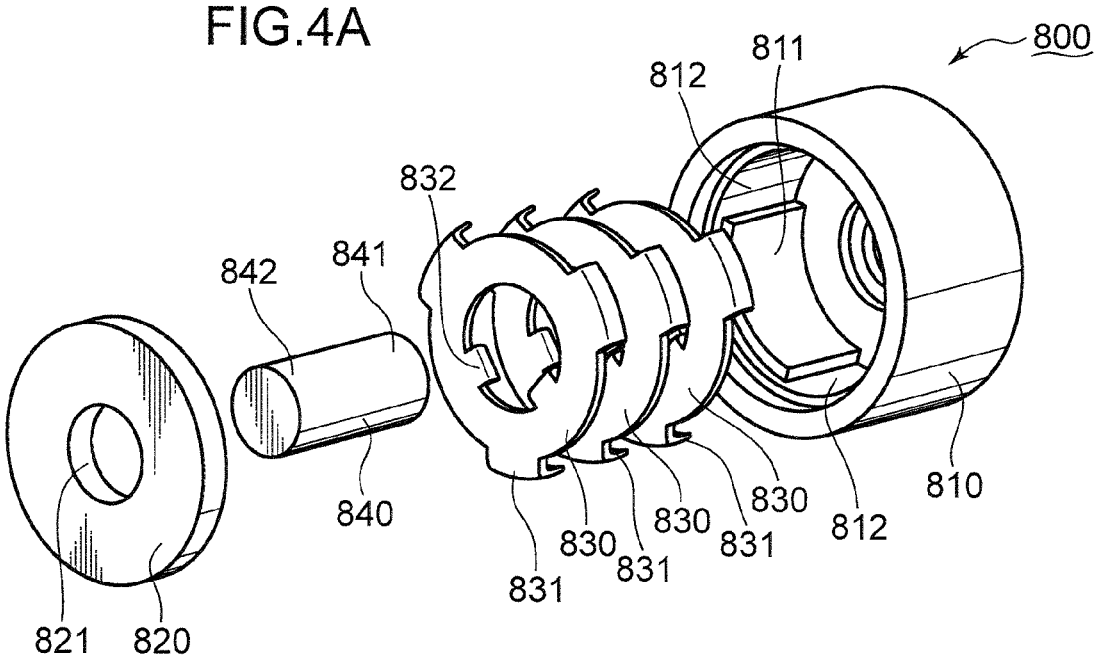
FIG. 4A is a schematic perspective view depicting an exploded torque limiter used for the interlocking mechanism shown in FIG. 3.
Figure 4B:
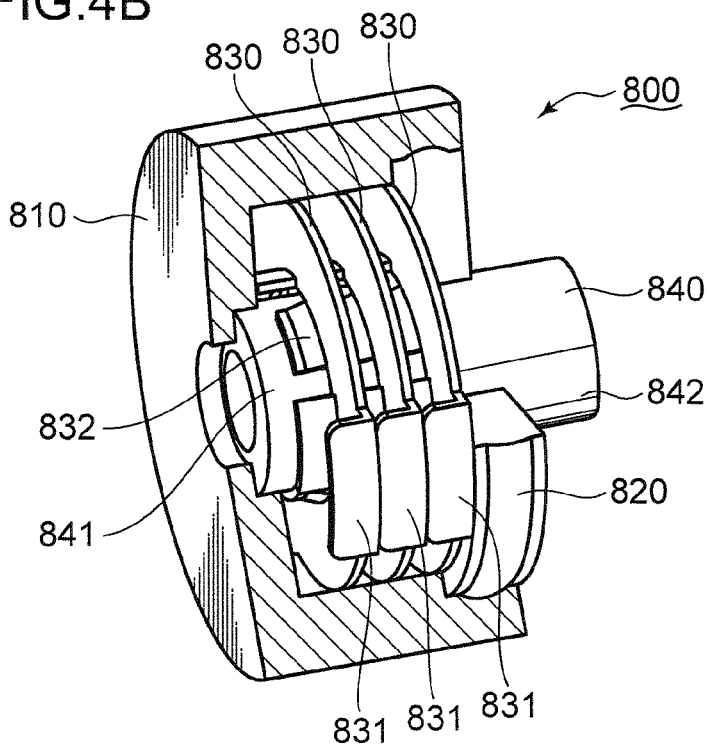
FIG. 4B is a schematic perspective view depicting the assembled torque limiter used for the interlocking mechanism shown in FIG. 3.

FIGS. 4A and 4B show the torque limiter 800. FIG. 4A is a perspective view of the exploded torque limiter 800. FIG. 4B is a cross-sectional view of the assembled torque limiter 800. A commercially available and general torque limiter may be used for the transmission controller or the torque limiter. The interlocking mechanism 650 is further described with reference to FIGS. 3 to 4B.

The torque limiter 800 comprises a substantially cylindrical housing 810. The housing 810 includes a bottom and an opening confronting the bottom. The torque limiter 800 further comprises a shield ring 820 configured to close the opening of the housing 810, three plate spring rings 830 accommodated in the housing 810, and a shaft 840 inserted in the housing 810. The housing 810 further comprises a few bumps 811. Concavities 812 are defined among the bumps 811 intermittently formed along the inner surface of the housing 810, respectively. External teeth 831 are formed on a circumferential surface of the plate spring ring 830. The external teeth 831 protruding outward are placed in the concavities 812 defined inside the housing 810. As a consequence, the housing 810 and the plate spring ring 830 integrally rotate together.

The plate spring ring 830 includes an internal tooth 832. The internal tooth 832 protruding from an inner circumferential edge of the plate spring ring 830 is pressed to the shaft 840 inserted in the plate spring ring 830. If a torque (torsional moment) less than a predetermined value is applied to the torque limiter 800, the shaft 840 and the plate spring ring 830 integrally rotate. If a torque (torsional moment) more than the predetermined value is applied to the torque limiter 800, the shaft 840 runs idle with respect to the plate spring ring 830.

A rotatable base end 841 of the shaft 840 is held by a concave in the bottom of the housing 810. A tip 842 of the shaft 840 protrudes from the housing 810 through an opening 821 defined in the shield ring 820. The tip 842 of the shaft 840 protruding from the housing 810 supports the relay gear 653. The housing 810 is connected to the cylinder 655 of the lever 654. In the present embodiment, the housing 810 and/or the plate spring ring 830 are/is exemplified as the first element connected to the lever 654. The shaft 840 is exemplified as the second element connected to the relay gear 653.

Figure 5:
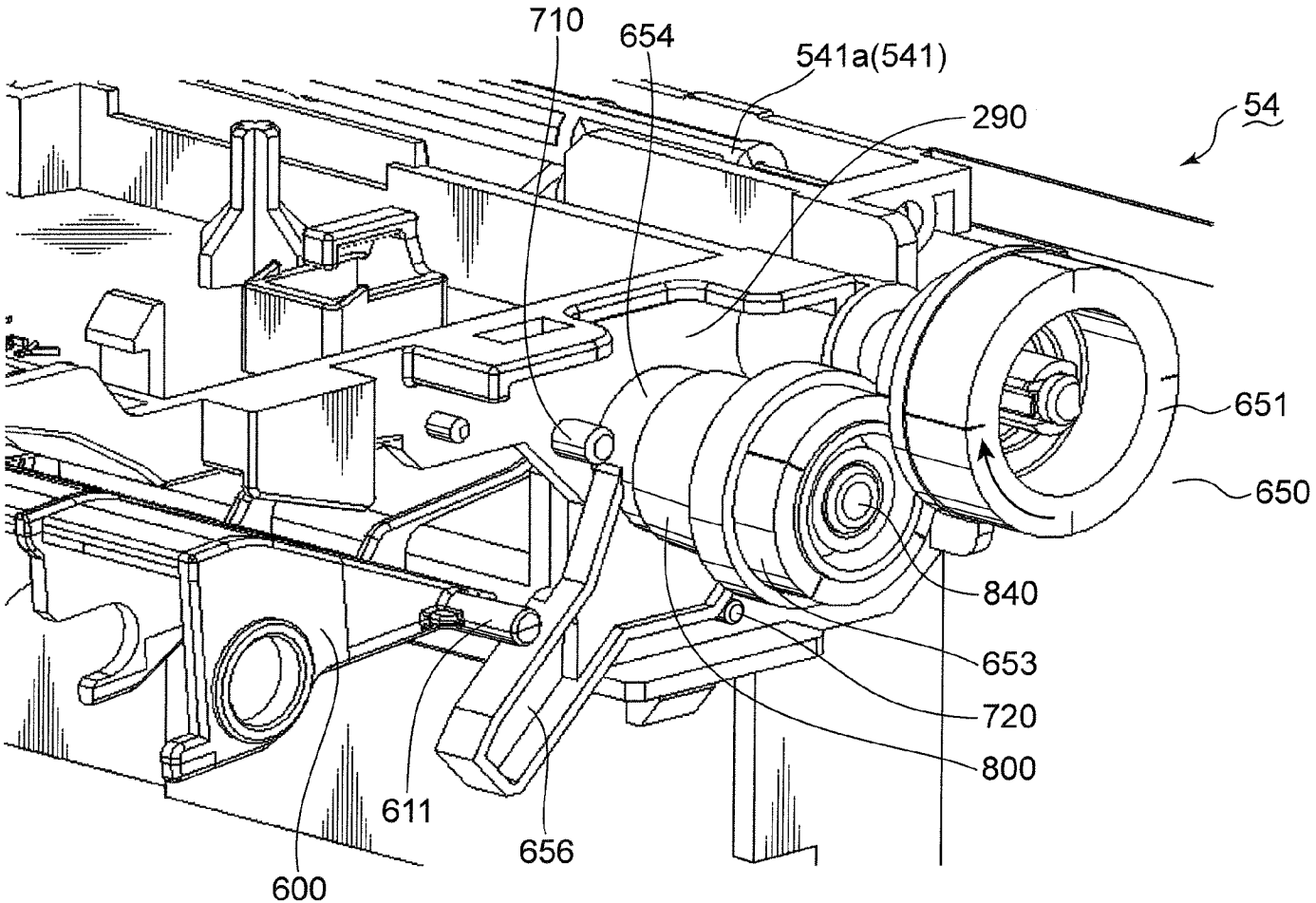
FIG. 5 is a perspective view depicting the interlocking mechanism of the image forming apparatus shown in FIGS. 1 and 2.

FIG. 5 is an enlarged perspective view of the discharging unit 54. Like FIG. 3, in FIG. 5, the housing 2 is partially omitted to clearly show the guide member 600. Like FIG. 3, the remaining portion of the housing 2 is described as "housing wall 290". The guide member 600 shown in FIG. 5 is located in the second position. The interlocking mechanism 650 is further described with reference to FIGS. 3 to 5.

As shown in FIGS. 3 and 5, the interlocking mechanism 650 comprises first and second pins 710, 720 protruding from the outer surface of the housing wall 290. The first pin 710 is disposed above the second pin 720. The first pin 710 and the second pin 720 collaboratively define a rotary range of the lever 654.

When the guide member 600 is rotated from the second position shown in FIG. 5 to the first position shown in FIG. 3, the drive gear 651 changes the rotary direction from a direction indicated by an arrow in FIG. 5 to a direction indicated by an arrow in FIG. 3, so that the drive gear 651 changes the rotary direction of the upper roller 541*a* of the discharge roller pair 541 from the second rotary direction to the first rotary direction. As a result, the drive force of the relay gear 653 received from the drive gear 651 is transmitted to the lever 654 via the torque limiter 800. As a consequence, the arm 656 of the lever 654 rotates upward. The guide member 600 rotates toward the first direction via the pin 611 contacting the upper edge 659 of the arm 656.

As shown in FIG. 3, when the guide member 600 reaches the first position, the arm 656 of the lever 654 contacts the first pin 710. Even after the guide member 600 reaches the first position, the upper roller 541*a* of the discharge roller pair 541 keeps rotating in the first rotary direction as the sheet S is discharged. As a result, the torsional moment applied to the torque limiter 800 increases.

As described in the context of FIGS. 4A and 4B, the torsional moment applied to the torque limiter 800 more than the predetermined value causes idle running between the shaft 840 of the torque limiter 800 and the plate spring ring 830. Consequently, the torque limiter 800 limits the transmission of the drive force from the relay gear 653 to the lever 640 during a period from arrival of the guide member 600 at the first position to initiation of the rotation of the guide member 600 toward the second position. As a result, it is less likely that excessive load is applied to the second transmission element (relay gear 653) and/or the lever 654.

When the guide member 600 is rotated from the first position shown in FIG. 3 to the second position shown in FIG. 5, the drive gear 651 changes the rotary direction from the direction indicated by the arrow in FIG. 3 to the direction indicated by the arrow in FIG. 5, so that the drive gear 651 changes the rotary direction of the upper roller 541*a* of the discharge roller pair 541 from the first rotary direction to the second rotary direction. As a result, the drive force of the relay gear 653 received from the drive gear 651 is transmitted to the lever 654 via the torque limiter 800. Consequently, the arm 656 of the lever 654 rotates downward. The guide member 600 biased toward the second position by the torsion bar spring 952 used for connection between the housing wall 290 and the guide member 600 rotates toward the second position, following up the arm 656 of the lever 654 rotating downward.

As shown in FIG. 5, when the guide member 600 reaches the second position, the arm 656 of the lever 654 contacts the second pin 720. The upper roller 541*a* of the discharge roller pair 541 keeps rotating in the second rotary direction in order to perform the double sided printing on the sheet S even after the guide element 600 reaches the second position. As a result, the torsional moment applied to the torque limiter 800 increases.

As mentioned above, the torsional moment applied to the torque limiter 800 more than the predetermined value causes idle running between the shaft 840 of the torque limiter 800 and the plate spring ring 830. Consequently, the torque limiter 800 limits the transmission of the drive force from the relay gear 653 to the lever 654 during a period from arrival of the guide member 600 at the second position to initiation of rotation of the guide member 600 toward the first position.

The above mentioned principle of limiting the drive force by the torque limiter 800 may be appropriately applied to the case of the lever 654 actively rotating the guide member 600 toward the second position and/or to the case of the torsion bar spring 952 used for the connection between the housing wall 290 and the guide member 600 to bias the guide member 600 toward the first position.

According to the present embodiment, the above mentioned principle of the conveyor is applied to the discharging unit 54 of the image forming apparatus 1. The above mentioned principle of the conveyor may be, however, applied to any apparatuses configured to convey the sheet S. The above mentioned principle of the conveyor may be applied to any other apparatuses configured to perform other arbitrary processes on the sheet S than the image forming apparatus 1.

According to the present embodiment, the upper roller 541*a* of the discharge roller pair 541 is used as the conveyance element configured to rotate in the first rotary direction and the second rotary direction. Alternatively, an arbitrary conveyance element (e.g. vacuum belt) configured to convey the sheet S may be used as the conveyance element.

This application is based on Japanese Patent application No. 2010-119668 filed in Japan Patent Office on May 25, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A conveyor including a conveyance element configured to rotate in a first rotary direction for sending in a first direction a sheet conveyed along a first path and in a second rotary direction opposite to the first rotary direction for sending the sheet in a second direction opposite to the first direction into a second path comprising:

a guide member configured to rotate between a first position where the first path opens and a second position where the first path closes and the second path opens;

a first transmission element attached to an end of a shaft of the conveyance element to transmit a drive force to the conveyance element;

a lever configured to rotate the guide member to one of the first position and the second position;

a second transmission element connected with the first transmission element to transmit the drive force to the lever; and a transmission controller configured to control transmission of the drive force from the second transmission element to the lever, wherein the transmission controller transmits the drive force from the second transmission element to the lever while the lever rotates the guide member, the lever includes an arm that comes into contact with the guide member, rotation of the arm in one direction makes the guide member rotate to one of the first and second positions, and the guide member rotates to another of the first and second positions with the arm rotating in another direction.

2. The conveyor according to claim 1, wherein the lever rotates the guide member toward the first position when the first transmission element rotates the conveyance element in the first rotary direction, and the transmission controller limits transmission of the drive force from the second transmission element to the lever during a period from arrival of the guide member at the first position to rotation of the guide member toward the second position.

3. The conveyor according to claim 2, further comprising a first pin configured to define a rotatable range of the lever, wherein the first transmission element includes a drive gear configured to transmit the drive force to the conveyance element, the second transmission element includes a relay gear configured to engage with the drive gear, the transmission controller includes a torque limiter including a first element connected to the lever and a second element connected to the relay gear, and the second element runs idle with respect to the first element when a torsional moment applied to the torque limiter by rotation of the relay gear while the lever abuts the first pin exceeds a predetermined value.

4. The conveyor according to claim 1, wherein the lever rotates the guide member toward the second position when the first transmission element rotates the conveyance element in the second rotary direction, and the transmission controller limits transmission of the drive force from the second transmission element to the lever during a period from arrival of the guide member at the second position to rotation of the guide member toward the first position.

5. The conveyor according to claim 4, further comprising a second pin configured to define a rotating range of the lever, wherein the first transmission element includes a drive gear configured to transmit the drive force to the conveyance element, the second transmission element includes a relay gear configured to engage with the drive gear, the transmission controller includes a torque limiter including a first element connected to the lever and a second element connected to the relay gear, and the second element runs idle with respect to the first element when a torsional moment applied to the torque limiter by the rotation of the relay gear while the lever abuts the second pin exceeds a predetermined value.

6. The conveyor according to claim 1, further comprising a biasing member configured to bias the guide member toward the second position, wherein the biasing member rotates the guide member toward the second position in accordance with rotation of the lever when the first transmission element rotates the conveyance element in the second rotary direction, and the transmission controller limits transmission of the drive force from the second transmission element to the lever during a period from arrival of the guide member at the second position to rotation of the guide member toward the first position.

7. The conveyor according to claim 1, further comprising a biasing member configured to bias the guide member toward the first position, wherein the biasing member rotates the guide member toward the first position in accordance with rotation of the lever when the first transmission element rotates the conveyance element in the first rotary direction, and the transmission controller limits transmission of the drive force from the second transmission element to the lever during a period from arrival of the guide member at the first position to rotation of the guide member toward the second position.

8. An image forming apparatus for forming an image on a sheet comprising:

an image forming unit configured to form the image on the sheet;

a housing configured to define a first path for guiding the sheet fed from the image forming unit and a second path for guiding the sheet on which the image is formed back to the image forming unit; and a conveyor including a conveyance element configured to rotate in a first rotary direction to send the sheet transferred along the first path in a direction to discharge the sheet outside the housing and in a second rotary direction to pull the sheet back into the housing to send the sheet to the second path, wherein the conveyor includes:

a first transmission element attached to an end of a shaft of the conveyance element to transmit a drive force to the conveyance element;

a lever configured to rotate a guide member to one of a first position where the first path opens and a second position where the first path closes and the second path opens;

a second transmission element connected with the first transmission element to transmit the drive force to the lever; and a transmission controller configured to control transmission of the drive force from the second transmission element to the lever, and the transmission controller transmits the drive force from the second transmission element to the lever while the lever rotates the guide member, the lever includes an arm that comes into contact with the guide member, rotating the arm in one direction makes the guide member rotate to one of the first and second positions, and the guide member rotates to another of the first and second positions with the arm rotating in another direction.

9. A conveyor including a conveyance element configured to rotate in a first rotary direction for sending in a first direction a sheet conveyed along a first path and in a second rotary direction opposite to the first rotary direction for sending the sheet in a second direction opposite to the first direction into a second path comprising:

a guide member configured to rotate between a first position where the first path opens and a second position where the first path closes and the second path opens;

a first transmission element attached to an end of a shaft of the conveyance element to transmit a drive force to the conveyance element;

a lever configured to rotate the guide member to one of the first position and the second position;

a second transmission element connected with the first transmission element to transmit the drive force to the lever; and a transmission controller configured to control transmission of the drive force from the second transmission element to the lever, wherein the transmission controller transmits the drive force from the second transmission element to the lever while the lever rotates the guide member, the lever includes an arm that comes into contact with the guide member, rotation of the arm in one direction makes the guide member rotate to one of the first and second positions, and rotation of the arm in another direction permits the guide member to rotate to another of the first and second positions independent of any direct driving force by the arm of the lever.

10. The conveyor according to claim 9, further comprising a torsion spring for rotating the guide member to the other of the first and second positions.

* * * * *